US006628247B2

(12) United States Patent
Toffolo et al.

(10) Patent No.: US 6,628,247 B2
(45) **Date of Patent: *Sep. 30, 2003**

(54) DISPLAY SYSTEM WITH LATENT IMAGE REDUCTION

(75) Inventors: Daniel Toffolo, Dearborn, MI (US); Silviu Palalau, Birmingham, MI (US); William Rogers, Soffield, CT (US); Masazumi Sone, Saline, MI (US)

(73) Assignee: Lear Automotive Dearborn, Inc., Southfield, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/067,132

(22) Filed: Apr. 27, 1998

(65) Prior Publication Data

US 2001/0026285 A1 Oct. 4, 2001

(51) Int. Cl.[7] ..... G09G 3/00; G09G 3/20; G09G 5/00

(52) U.S. Cl. ..... 345/31; 345/56; 345/867

(58) Field of Search ..... 345/473–475, 345/435, 113, 115, 116, 121, 204, 342, 112, 690, 696, 698, 31, 56, 867, 788; 395/327

(56) References Cited

U.S. PATENT DOCUMENTS

| | | | | | |
|---|---|---|---|---|---|
| 4,722,005 | A | * | 1/1988 | Ledenbach | 345/690 |
| 4,951,229 | A | * | 8/1990 | DiNicola et al. | 345/473 |
| 5,384,593 | A | * | 1/1995 | Gell, Jr. et al. | 345/112 |
| 5,680,535 | A | * | 10/1997 | Harbin et al. | 345/473 |
| 5,687,331 | A | * | 11/1997 | Volk et al. | 395/327 |
| 5,831,638 | A | * | 11/1998 | West et al. | 345/501 |
| 5,933,130 | A | * | 8/1999 | Wagner | 345/112 |
| 5,963,206 | A | * | 10/1999 | Ulrich et al. | 345/342 |
| 5,966,691 | A | * | 10/1999 | Kibre et al. | 345/473 |
| 6,124,853 | A | * | 9/2000 | Palalau et al. | 345/212 |

* cited by examiner

*Primary Examiner*—Bipin Shalwala
*Assistant Examiner*—David L Lewis
(74) *Attorney, Agent, or Firm*—MacMillan, Sobanski & Todd, LLC

(57) ABSTRACT

A display system reduces latent image formation by shifting an image between a first position and a second position, displaced only a few pixels from the first position. Preferably, the image is displayed briefly simultaneously at the first and second positions and then displayed only in the second position for a second predetermined time period.

18 Claims, 2 Drawing Sheets

DISPLAY SYSTEM WITH LATENT IMAGE REDUCTION

BACKGROUND OF THE INVENTION

The present invention relates generally to a display system and a method for reducing latent images in displays, particularly electro-luminescent displays (ELDs), VFDs, FEDs or CRTs, and assuring that the emissive elements of the display "age" more evenly.

The effect of uneven aging of the emissive elements in displays, particularly ELDs displays, is well known. Pixels which are activated more than others will "age" sooner than others. As a result, a "latent" image formed by the "aged" pixels will become visible on the display.

It is known to dim the screen after a period of inactivity by the user, indicated by a lack of input on a user-input device. Alternatively, "screen savers" display moving or changing images which more evenly age the pixels; however, none of these techniques is implemented during use. There may be portions of the display which remain activated for extended periods of time while sufficient activity is occurring in other portions of the screen to prevent the screensaver from activating or the screen to dim.

High resolution reconfigurable displays are being used more frequently in vehicles. Latent images in these displays is a particular problem, since long periods of time without input from a user-input device are not unusual and do not normally mean that the screen can be dimmed or that a "screen saver" can replace the information being displayed. For example, a display which includes vehicle gauges, such as the vehicle speedometer, might operate continuously for hours without a user input, but the information must be displayed constantly. Therefore, the known techniques for reducing latent images are inapplicable.

SUMMARY OF THE INVENTION

The present invention provides a display system and method for reducing the latent image caused by uneven aging of the emissive elements in a display. Generally, the display system displays an image at a first position for a first predetermined time period. The display system then displays the image at a second position only a few pixels displaced from the first position for a second predetermined period of time. Preferably, the image is displayed in the first and second positions simultaneously briefly, and then only in the second position. This reduces the noticeability of the transition of the image from the first position to the second position. In the second position, different pixels will be activated, thus more evenly aging pixels on the screen.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DETAILED DESCRIPTION OF THE PREFERRED EMBODIMENT

Figure 1:
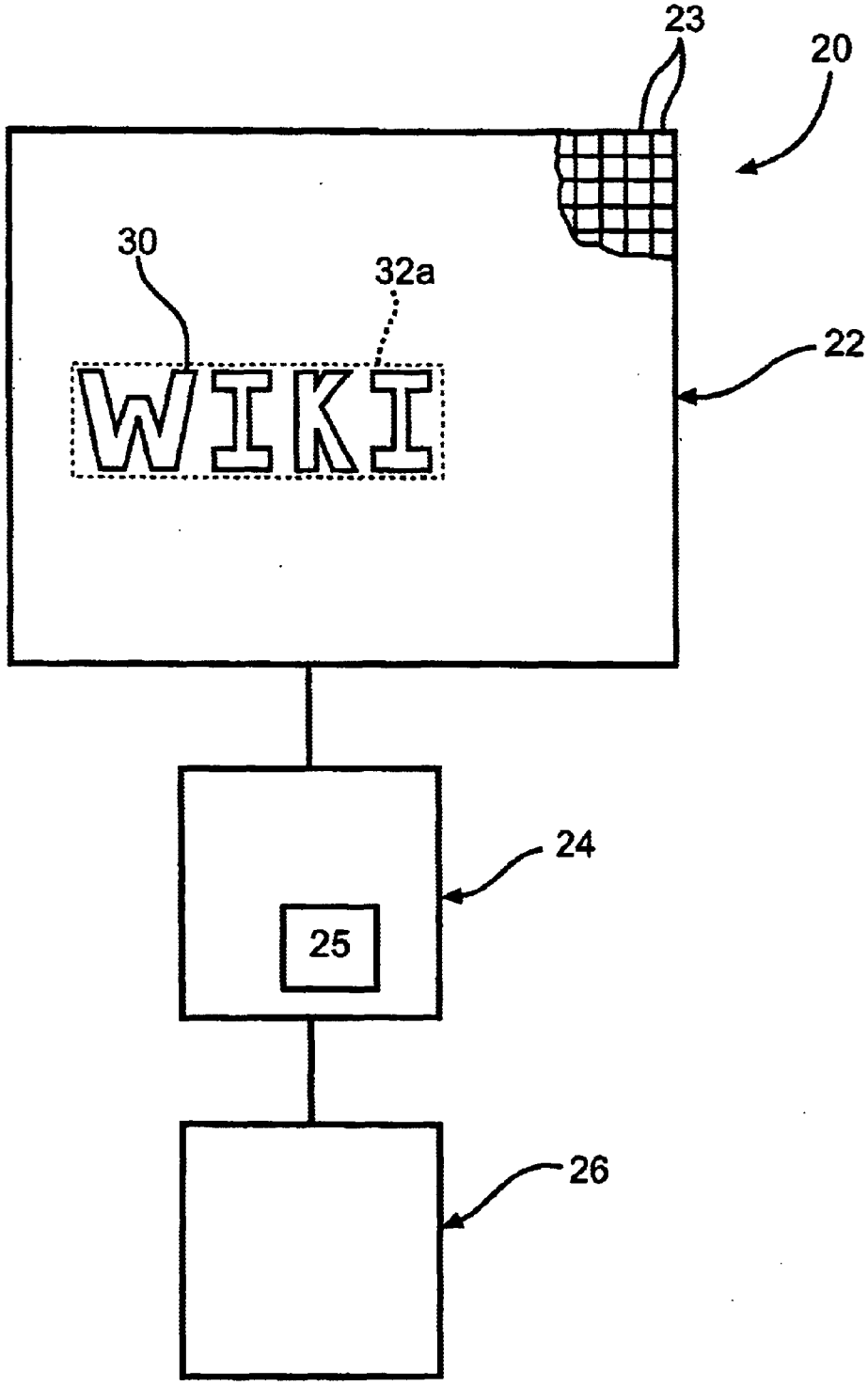
FIG. 1 is a schematic of the display system of the present invention.

A display system 20 of the present invention is shown schematically in FIG. 1. The display system 20 includes a display 22, such as an ELD, VFD, FED or CRT, having a matrix of pixels 23, as is generally known. The illumination of the pixels 23 in display 22 is controlled by a display controller 24 having a memory 25, such as VRAM. It should be recognized that the exact configuration and software of the display controller 24 will depend upon the type of display 22. The display controller 24 is preferably appropriate to the technology used by the display 22, again, preferably ELD.

The display controller 24 drives the display 22 to illuminate a plurality of pixels in a manner generally known according to a video source 26, which may be a CPU. Based upon the information from the video source 26 stored in the memory 25, the display controller 24 causes a plurality of pixels to be illuminated on display 22, forming an image 30 in a first position 32*a* on the display 22. Although for exemplary purposes, the image 30 is shown as text, it should be recognized that the image 30 could be any image on display 22, and is preferably the entire image on display 22, including any icons, text or other images.

Figure 2:
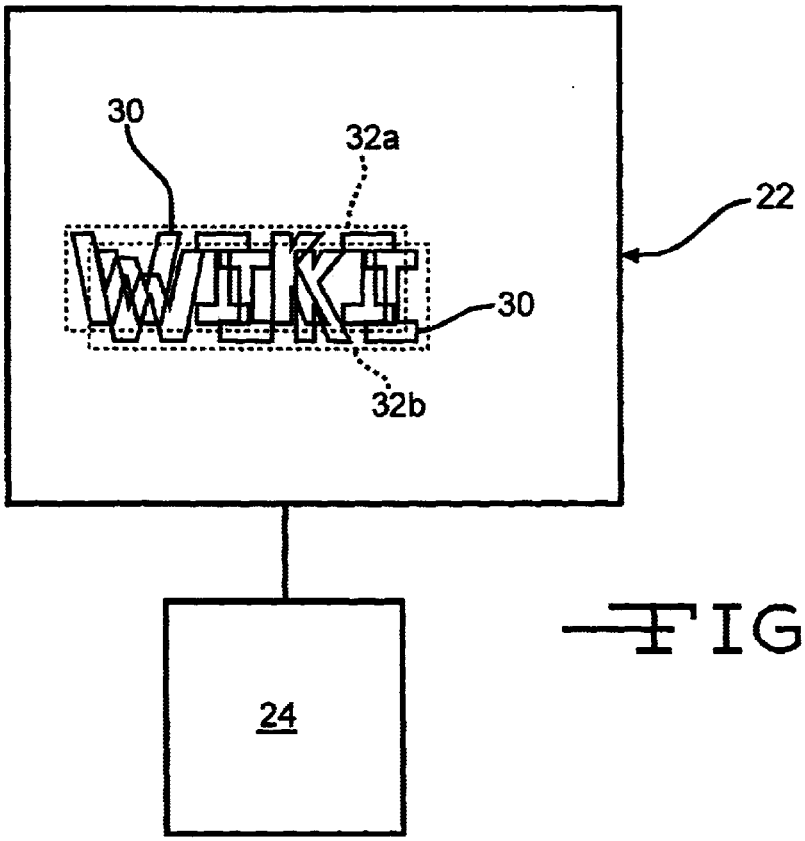
FIG. 2 is the display system of FIG. 1, with the image displayed simultaneously in the first and second positions.

After a first predetermined time period, such as two minutes (or which may be user-defined through software) the display controller 24, via its software, displays the image 30 in a second position 32*b*, while simultaneously displaying the image 30 in the first position 32*a*, such as is shown in FIG. 2. This is preferably accomplished by the software in the display controller 24, without actually changing the content of memory 25. Preferably, the second position 32*b* is displaced by only a single row and/or single column of pixels from the first position 32*a*. For illustrative purposes, the second position 32*b* is shown in FIG. 2 displaced diagonally, as shown, from the first position 32*a*. The image 30 is displayed simultaneously in the first and second positions 32*a,b* for an interim period, which is preferably approximately 0.1 seconds. Preferably, the intensities of the image 30 in the first position 32*a* is shifted during the interim period to the image 30 in the second position 32*b*. For example, the intensity of image 30 at the first position 32*a* is preferably decreased proportionally as the intensity of the image 30 at the second position 32*b* is increased. The change in intensity for the images 30*a,b* is preferably linear over the interim period. In this manner, the total intensity of the display 22 is not altered and the change from the first position 32*a* to the second position 32*b* is not noticeable.

Figure 3:
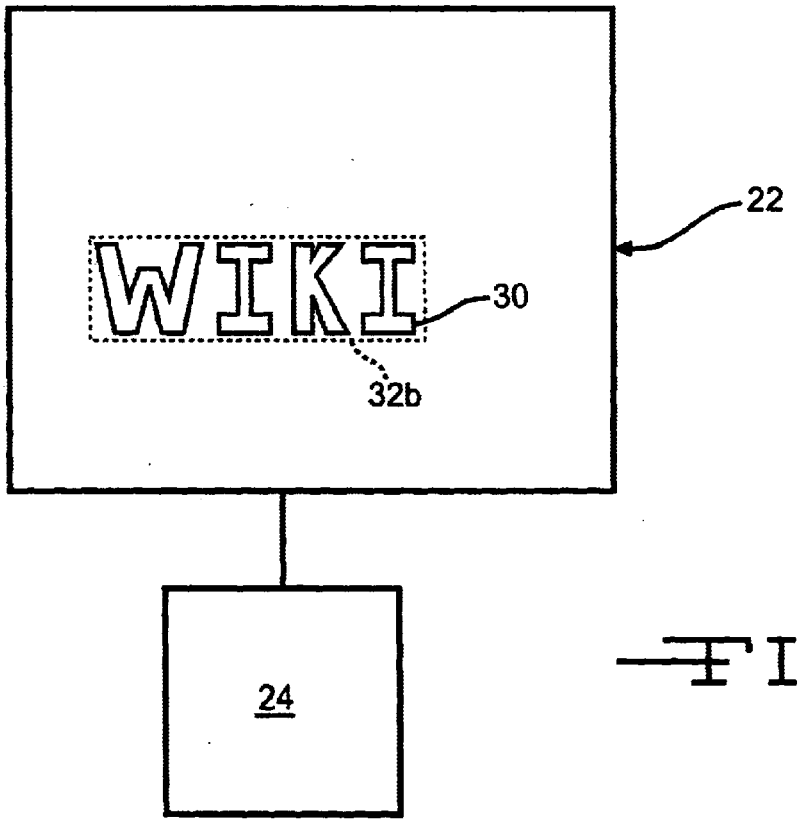
FIG. 3 is the display system of FIG. 1 with the image displayed in the second position only.

After the interim period, the intensity of the image 30 in the first position 32*a* is zero, leaving only the second image 30*b* in the second position 32*b*, as shown in FIG. 3. In this manner, different pixels 23 in display 22 are activated, while the user has not perceived that the image 30 has been moved. It is recognized that some of the same pixels activated by the image 30*a* in the first position 32*a* will remain activated by the image 30 in the second position 32*b*. Therefore, it may be desirable to continue shifting the image 30 to a third position, preferably also downwardly to the right in the same manner as described with respect to FIGS. 1–3. Subsequently, the image may be shifted in a similar manner in other directions, such as to the left and/or upward, until the image 30 eventually returns to the first position 32*a*.

The total number of pixels by which image 30 is ultimately displaced from the first position 32*a* will depend upon the number of pixels in display 22, and possibly, the content of image 30. However, preferably for a standard display of 640 by 480 pixels, the third position is displaced three pixels to the right and two pixels downward from the first position 32*a*. Preferably, the display 22 has more pixels than the image 30 displayed so that there is room to move the image 30 without cutting part of it off.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A method usable in a vehicle for displaying an image representative of information responsive to an operator's control of the vehicle, said image being displayed on a display comprising a plurality of pixels, said method comprising the steps of:

obtaining the information responsive to the operator's control of the vehicle;

displaying said image representative of the information responsive to the operator's control of the vehicle at a first position on the display; and displaying said image at a second position on the display, said second position being displaced from said first position in such a manner that said image appears to an observer to be currently unmoving at all times.

2. The method of claim 1, wherein the first-mentioned displaying step includes not displaying said image at said second position, and the second-mentioned displaying step includes not displaying said image at said first position, said method further including the intermediate step, occurring between said first and second displaying steps, of displaying said image simultaneously at said first and second positions.

3. The method of claim 2, wherein said intermediate step includes the step of simultaneously decreasing an intensity of said image at said first position while increasing an intensity of said image at said second position.

4. The method of claim 2, wherein said first displaying step displays said image at said first position for a first predetermined period of time, said intermediate step displays said image at said first and second positions for a second predetermined period of time, and said second displaying step displays said image at said second position for a third predetermined period of time.

5. The method of claim 1, wherein said second position is displaced one pixel from said first position.

6. The method of claim 1, wherein said image is displaced from said first position by a number of said pixels depending on a content of said image.

7. A display system for use in a vehicle, comprising:

a CPU for obtaining information responsive to an operator's control of the vehicle;

a display; and a display controller activating an image representative of information responsive to an operator's control of the vehicle at a first position on said display at a first time, said display controller moving said image, in such a manner that said image appears to an observer to be currently unmoving at all times, to be at a second position on said display at a later time, said second position being displaced from said first position.

8. The display system of claim 7, wherein at the first time said display controller does not display said image at said second position, at the second time said display controller does not display said image at said first position, and at a third time, occurring between the first and second times, said display controller displays said image simultaneously at said first and second positions.

9. The display system of claim 8, wherein at the third time said display controller simultaneously decreases an intensity of said image at said first position while increasing an intensity of said image at said second position.

10. The display system of claim 8, wherein at the first time said display controller displays said image at said first position for a first predetermined period of time, at the third time said display controller displays said image at said first and second positions for a second predetermined period of time, and at the second time said display controller displays said image at said second position for a third predetermined period of time.

11. The display system of claim 7, wherein said second position is displaced one pixel from said first position.

12. The display system of claim 7, wherein said display comprises a plurality of pixels, and said image is displaced from said first position by a number of said pixels depending on a content of said image.

13. A display system for use in a vehicle, comprising:

means for obtaining information responsive to an operator's control of the vehicle;

a display;

means for activating an image representative of information responsive to an operator's control of the vehicle at a first position on said display at a first time; and means for moving said image, in such a manner that said image appears to an observer to be currently unmoving at all times, to be at a second position on said display at a later time, said second position being displaced from said first position.

14. The display system of claim 13, wherein at the first time said means for activating does not cause said image to be displayed at said second position, at the second time said means for moving does not cause said image to be displayed at said first position, and at a third time, occurring between the first and second times, said means for moving causes said image to be displayed simultaneously at said first and second positions.

15. The display system of claim 14, wherein at the third time said means for moving simultaneously decreases an intensity of said image at said first position while increasing an intensity of said image at said second position.

16. The display system of claim 14, wherein at the first time said means for activating causes said image to be displayed at said first position for a first predetermined period of time, at the third time said means for moving causes said image to be displayed at said first and second positions for a second predetermined period of time, and at the second time said means for moving causes said image to be displayed at said second position for a third predetermined period of time.

17. The display system of claim 13, wherein said second position is displaced one pixel from said first position.

18. The display system of claim 13, wherein said display comprises a plurality of pixels, and said image is displaced from said first position by a number of said pixels depending on a content of said image.

* * * * *